US005159144A

United States Patent [19]

Fujisawa et al.

[11] Patent Number: 5,159,144

[45] Date of Patent: Oct. 27, 1992

[54] ELECTRONIC MUSICAL INSTRUMENT EMPLOYING TONE GENERATOR SELECTION BASED ON INTEGRATED RESIDUAL ENVELOPE VOLUME

[75] Inventors: Minoru Fujisawa; Satoshi Otsuka; Tetsuaki Nunoyama, all of Hamamatsu, Japan

[73] Assignee: Roland Corporation, Osaka, Japan

[21] Appl. No.: 545,811

[22] Filed: Jun. 29, 1990

[51] Int. Cl.[5] ..... G10H 1/22; G10H 5/00

[52] U.S. Cl. ..... 84/656; 84/DIG. 2

[58] Field of Search ..... 84/607, 618, 627, 633, 84/656, 663, 665, 684, 702, 703, 711, 738, 741, 742, DIG. 2

[56] References Cited

U.S. PATENT DOCUMENTS 4,703,680 11/1987 Wachi et al. ..... 84/627 X

*Primary Examiner*—Stanley J. Witkowski

[57] ABSTRACT

An electronic musical instrument allots musical tone-generating channels to new musical tones by calculating an integrated residual generated volume or a substitute values corresponding thereto for each current musical tones; and determining which of musical tone-generating channels has a minimum such volume or substitute value. The instrument may, alternatively, allot a tone generating channel for a new musical tone by detecting a minimum envelope level of those already allotted musical tones; selecting those channels having envelope levels falling within a determined range defined based on and including the detected minimum level; and determining which channel selected by the selecting means has a minimum residual generated volumes or substitute values corresponding thereto. The residual generated volumes are determined by an equation:

$$WL = \int_{t_o}^{t_{end}} V(t)dt$$

wherein V(t) is an envelope level at an instant "t" during a period from the given instant "$t_o$" and to the end point "$t_{end}$" of the musical tone. The substitute values are given by a further equation;

$$WL = LEV_o * LEV_o/(-RT_o)$$

wherein $LEV_o$ is the envelope level at the given instant, and $RT_o$ is a rate of change of the attenuating envelope level.

13 Claims, 10 Drawing Sheets

ELECTRONIC MUSICAL INSTRUMENT EMPLOYING TONE GENERATOR SELECTION BASED ON INTEGRATED RESIDUAL ENVELOPE VOLUME

BACKGROUND OF THE INVENTION

1. Field of the Invention

The invention relates to an electronic musical instrument having a predetermined number of musical tone-generating channels to which new desired musical tones are allotted.

2. Description of Related Art

There is known, for instance, an electronic musical instrument system that is adapted to allot a new musical tone to the musical tone-generating channel corresponding to the key which has been released earliest There is also known another electronic musical instrument system wherein a new musical tone is allotted, in a simple manner, to musical tone-generating channel generating the previous musical tone of the lowest envelope level, the envelope level of each musical tone being attenuated over the course of time.

SUMMARY OF THE INVENTION

When a musical tone-generating channel is selected to be free for the new allotted musical tone, the selected channel should not much affect the sound of the music which is being played. In other words, a residual integrated volume of the musical tone which would otherwise be generated through the selected musical tone-generating channel if it were not freed should be as little as possible.

Therefore, it will be understood from the above-described point of view that the first known system of electronic musical instrument is disadvantageous in a case wherein a key is successively depressed with a weaker touch after the same key or another key was previously depressed with a stronger touch. A musical tone-generating channel corresponding to the previously depressed key or the previous depression of the key shall be set free for a new musical tone, in the first known system of electronic musical instrument. This will result in a greater loss of generated volume, although the setting free of the musical tone-generating channel corresponding to the successively and weakly depressed key or the weaker successive depression of the key shall cause a lesser loss of the generated volume.

Similarly, the second known system of electronic musical instrument is also a problematic system because the waveform of the envelopes are varied due to pitches, timbres, touch-responses and the likes of the musical tones. In this case, the musical tone-generating channel which has been allotted to one musical tone of a lower envelope level but lasting longer might be selected for the new musical tone. This will also cause a greater loss of the volume to be generated. On the contrary, the setting free of the other channels allotted to musical tones of a higher envelope level but lasting shorter would not seriously affect the music which is being played.

Thus, a principal object of the present invention is to resolve the aforedescribed problems.

Another object of the present invention is to provide an electronic musical instrument which is adapted to inhibit the releasing of a musical tone-generating channel which has been generating a previous musical tone of a high envelope level, whereby any audible incongruity is prevented from being felt by listeners.

"Releasing" in this specification does not mean the "release part (R)" in the "A-D-S-R-curve" but denotes "setting free" of the channels.

According to a first aspect of the invention, an electronic musical instrument is provided to achieve the above objects and has, as shown in FIG. 1*a*, the following features:

(a) calculating means (1) for either calculating residual integrated volumes or substitute values corresponding thereto of current musical tones, which have been allotted respectively to musical tone-generating channels, and are to be further generated after a given instant of time until end points in the generation of the current musical tones; and (b) determining means (2) for determining which of the musical tone-generating channels corresponds to a minimum of such residual integrated volume or substitute value corresponding thereto as calculated by the calculating means (1).

The determining means (2) determines such musical tone-generating channel that has been allotted to a current musical tone which is calculated by the calculating means (1) to have the minimum residual integrated volume or the minimum substitute value corresponding thereto. A new musical tone will then be allotted to the musical tone-generating channel which is selected in this manner.

It will be apparent that in the described first aspect of the invention the musical tone-generating channels are successively set free or released without bringing about any significant undesirable influences upon the played music, thereby enabling the efficient and adequate utilization of said musical tone-generating channels.

The residual integrated volumes of the musical tones are given by the following equation;

$$WL = \int_{t_o}^{t_{end}} V(t)dt$$

wherein V(t) is an envelope level at an instant "t" during a period beginning at the given instant "$t_o$" and lasting to the end point "$t_{end}$" of the generation of musical tone.

The substitute values corresponding to the residual integrated volumes are given, for example, by the following another equation;

$$WL = LEV_o * LEV_o / (-RT_o)$$

wherein $LEV_o$ is the envelope level at the given instant during the attenuation process of envelope waveaform, and $RT_o$ is a rate of change per unit time of the envelope level which is attenuating in course of time, the rate of change being made use of to calculate said envelope level.

The substitute values may be obtained also by multiplying the residual integrated volumes or said substitute values corresponding thereto by appropriate correction factors.

According to a second aspect of the invention, an electronic musical instrument is provided to achieve the above objects and has, as shown in FIG. 1*b*, the following features:

(a) detecting means (5) for detecting a minimum envelope level among such envelope levels that will be found at a given instant of time as to musical tones which have respectively been allotted to musical tone-generating channels;

(b) selecting means (6) for selecting some of the musical tone-generating channels to which are allotted such musical tones having the envelope levels falling within a predetermined range at the given instant of time, the predetermined range being defined based on and including the minimum envelope level detected by the detecting means (5); and (c) determining means (7) for determining which of the musical tone-generating channels selected by the selecting means (6) corresponds to a minimum of such residual integrated volumes or substitute values corresponding thereto.

In other words, the determining means (7) determines such musical tone-generating channel that has been allotted to a current musical tone and that has the minimum residual integrated volume or the minimum substitute value corresponding thereto, the thus determined musical tone-generating channel being included in a group of musical tone-generating channels which are so selected and judged by the selecting means (6) as to have the envelope levels, at the given instant of time, which are within a range defined by the minimum envelope level detected by the detecting means (5); A new musical tone will then be allotted to the musical tone-generating channel which is determined in this manner.

It will now be apparent in the second aspect of the invention that on one hand the feeling of incongruity does not occur which would otherwise be caused by the muting of the musical tones of higher envelope levels, and on the other hand such musical tone-generating channels having a smaller effect on the played music are preferentially released in a sequential manner.

The residual integrated volumes are given approximately, for example, by the following equation;

$$WL = LEV_o * LEV_o / (-RT_o)$$

wherein $LEV_o$ is the envelope level found in an envelope waveform at the given time during the attenuation process of said envelope waveform, and $RT_o$ is a rate of change per unit time of the envelope level at said given time in said process.

The substitute values corresponding to the residual integrated volumes to be generated may be a remaining length of time which is found at the given instant during the attenuation process of envelope waveform. Alternatively, said substitute values may be a rate of change per unit time of the envelope level, the rate also being found at said instant.

The instant of time referred to above may either be an instant at which a command is given to the musical tone-generating channel to be set free for the new musical tone, or an instant at which the previous setting of an order of truncation is effected as to the musical tone-generating channels prior to the allotting thereof to the new musical tones.

BRIEF DESCRIPTION OF THE DRAWINGS

The invention will become more apparent from the following detailed description and the accompanying drawings, wherein:

FIGS. 2 to 9 illustrate embodiments of an electronic musical instrument according to the first aspect of the invention; in which;

FIGS. 2 to 5 show an outline of the musical instrument in a first embodiment, a basic flowchart executed by a microcomputer, a routine for the processing of key-depressions and another routine for the determining of a musical tone-generating channel, respectively, the routines being incorporated in the basic flowchart;

FIGS. 6 and 7 show a routine for the processing of key-depressions and another routine for the determining of a musical tone-generating channel, respectively, the routines being incorporated in a basic flowchart employed in a second embodiment;

FIGS. 8 and 9 show a modified routine for the processing of key-depressions and another modified routine for the determining of the musical tone-generating channel, respectively in a modification of the second embodiment;

DETAILED DESCRIPTION OF THE PREFERRED EMBODIMENTS

Figure 1A:
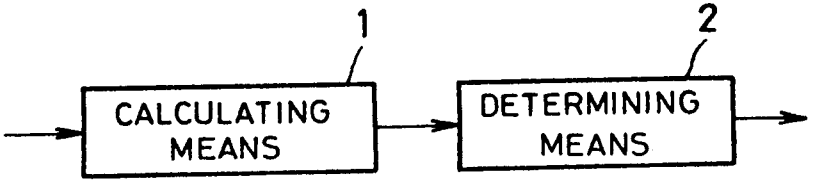
FIGS. 1*a* and 1*b* are block diagrams respectively illustrating the features constituting a first aspect and a second aspect of the present invention as defined in the claims.
Figure 1B:
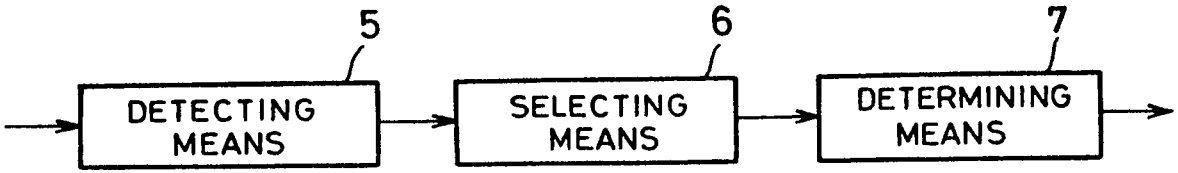

A first aspect of the invention will be described at first by means of an electronic musical instrument in a first embodiment and a second embodiment both illustrated in the drawings.

FIRST EMBODIMENT

The electronic musical instrument to which the first embodiment of the invention relates is adapted to generate musical tones of "percussive" nature which attenuate in course of time.

Figure 2:
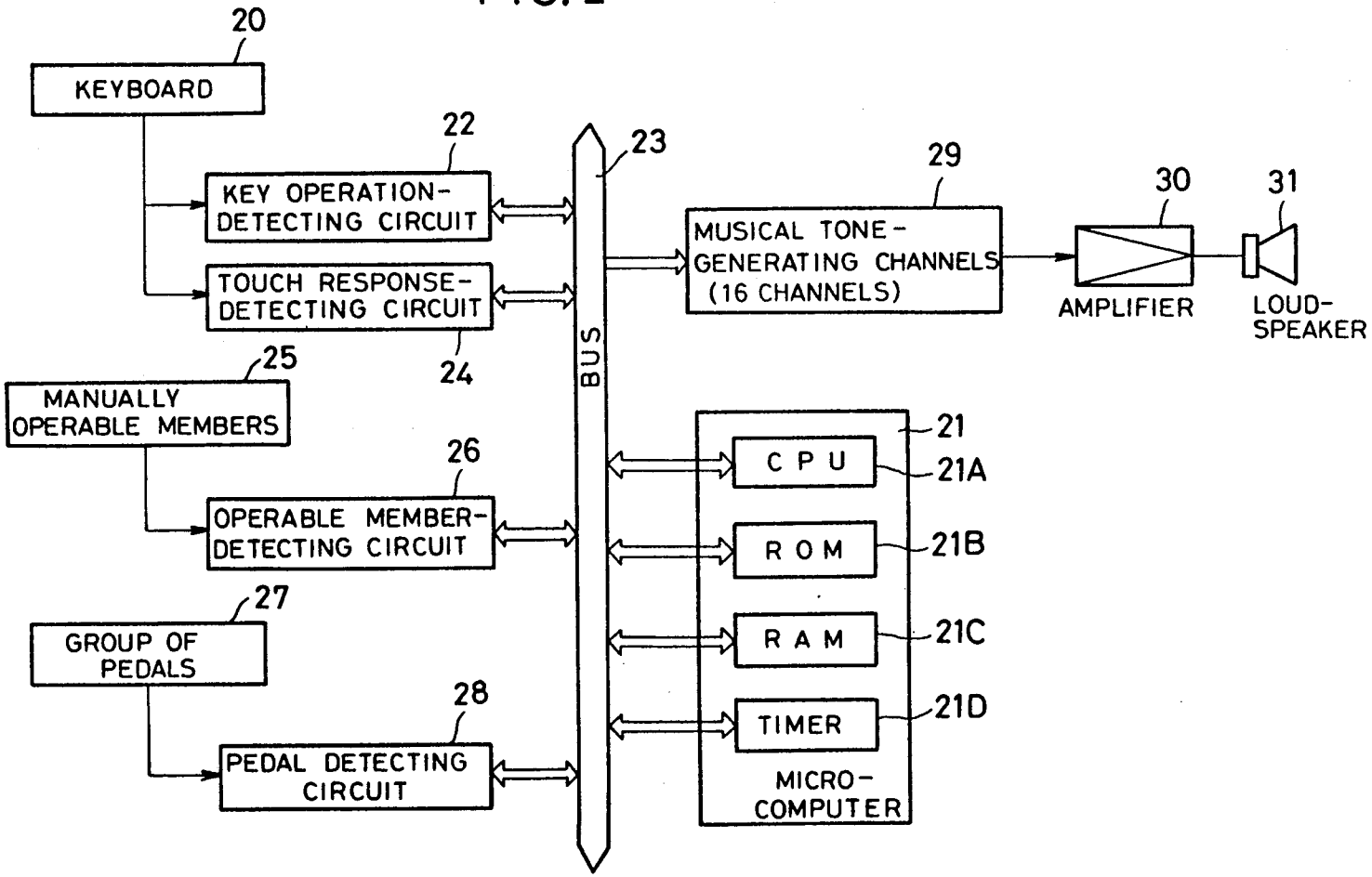

In FIG. 2, a keyboard 20 comprises a plurality of keys allotting pitches to musical tones which are to be generated. A key operation-detecting circuit 22 detects which keys have been operated and whether the operated keys are at their depressed state or at their released state. Pitch information indicating the pitches of the depressed keys as well as key-depression/-release information indicating said depressed or released states of the depressed keys are written to be stored in a buffer which is incorporated in the key operation-detecting circuit 22.

This information is expressed as key code data BKYC, as a key state flag BKYS and as key number data KEN which are input to a microcomputer 21 through a bus 23 under control by the microcomputer 21, the key number data KEN indicating the total number of the keys which have been changed in their states while they are stored in the buffer.

A touch response-detecting circuit 24 detects the key-depression speed and the touch strength of the keys when they are depressed. These parameters constitute a touch response information which is written to be stored in a buffer incorporated in the touch response-detecting circuit 24. The stored information is stored as touch response data BKTD which corresponds to the abovedescribed data BKYC and BKYS and is to be fed also to the microcomputer 21 through the bus 23 under control by said microcomputer.

A group of manually operable members 25 are utilized to select a timbre from various timbres including the piano timbre, the harpsichord timbre and the likes, or to adjust the volumes of generated musical tones. The microcomputer 21 is supplied also with operable member data MNPh which are obtained by detecting the states of said manually operable members by means of an operable member-detecting circuit 26.

A group of pedals 27 is further provided including a damper pedal and a "sostenuto" pedal. The damper pedal is pressed down to inhibit the damping or accelerated attenuation of the generated sound so as to produce a prolonged attenuation thereof. The "sostenuto" pedal is pressed down also to inhibit such quick damping of sound generated by the key which is being depressed when said "sostenuto" pedal is trodden, the release thereof after releasing the key-depression however allowing the generated sound to be quickly damped. The trodden states of those pedals 27 are detected by means of a pedal detecting circuit 28 so that they are input to the microcomputer in the form of a damper state flag FCDS and a "sostenuto" flag.

It will be apparent that the states of the manually operable members and of the pedals indicated respectively by the operable member data MNPh and the damper state flag FCDS are such current states that are found at the instant when those data or flag are transmitted to the microcomputer 21, under control by it. Further, a key data BKYD is composed of the key code BKYC, the key state flag BKYS and the touch response data BKTD. (Details of the sostenuto flag and the relevant processing thereof are given in some publications or books so that they are omitted here to simplify the description.)

The microcomputer 21 comprises a central processing unit (CPU) 21A for the execution of given programs, a read-only memory (ROM) 21B storing the given programs, a random-access memory (RAM) 21C functioning as a working memory needed to execute the given programs and also as registers which are allotted to and store the operable member data MNPh, the damper state flag FCDS and the key data BKYD, and a timer circuit 21D counting the time lapse during the execution of the programs. Said given programs are carried out based on the the operable member data MNPh, the damper state flag FCDS and the key data BKYD whereby a musical tone-generating circuit 29 which in the first embodiment comprises 16(sixteen) musical tone-generating channels is controlled. Thus, respective desired musical tone signals are produced through adequately allotted channels, and are subsequently output as audible musical sounds from a loudspeaker 31 after amplified in an amplifier 30.

Now, the fundamental operation of the electronic musical instrument so constructed as described above will be explained in detail referring to each step on a flowchart in FIG. 3.

Step A

A power source is turned on to start the given programs by clearing the RAM 21C of microcomputer 21 so as to be newly allotted to the registers and the like. At the same time, commands are given to the key operation-detecting circuit 22, the touch response-detecting circuit 24, the operable member-detecting circuit 26, the pedal detecting circuit 28 and the musical tone-generating circuit 29 in order to make the initial setting thereof.

Step B

The operable member data MNPh is read from the operable member-detecting circuit 26. By means of the thus read operable member data MNPh, preliminary parameters are found on a predetermined table stored in the ROM 21B. The preliminary parameters are then converted into a group of secondary parameters GTEm to be written in predetermined registers GTEmR. The registers GTEmR are respectively provided for the sixteen musical tone-generating channels constituting the musical tone-generating circuit 29, and are particularly provided for envelope waveform-generating channels which respectively correspond to said musical tone-generating channels.

Step C

The damper state flag FCDS which carries the value "1" for the trodden state of the damper pedal included in the group of pedals 27 is read from the pedal detecting circuit 28, and is written in a register FCDSR.

Step D

Reference is made here to the tone pitch information and the key-depression/-release information which have accumulated in the buffer after the previous reading of data from the key operation-detecting circuit 22 in the preceding cycle of processing. The key code BKYC produced according to those informations and the key state flag BKYS carrying "1" for the depressed state of key are read in the order of their occurrence in course of time. The key-depression/-release information is referred to also to read the key number data KEN indicating the number of keys which have undergone any changes in their states after said previous reading of data in the preceding cycle of processing. Similarly, the touch response data BKTD are also read from the touch response-detecting circuit 24 in the order of their occurrence in course of time.

The respective key data BKYD are then composed of key code BKYC, key state flag BKYS and touch response data BKTD which correspond to each other. The composed key data BKYD are subsequently written in the corresponding areas of register BKYR, also in the order of their occurrence in course of time.

Further, the total number KEN of the changed keys is written in a register BKENR, as a number BKEN of processing-waiting keys which are to be processed hereinafter.

Step E

A decision is made as to whether the processing of the key operation in accordance with key-depression or key-release has or has not completed, based upon whether the register BKENR does or does not carry "0" as the number BKEN of processing-waiting keys. If no, then the process goes to Step G.

Step F

If yes at the decision made at Step E, then envelope processing as described below is performed sequentially for the respective envelope waveform-generating channels.

(i) The envelope levels LEV, that is the envelope waveforms, are calculated making use of the predetermined groups of the rates $RT_j$ and the break points $LBP_j$ which have been computed in the depressed key-processing (at Step H) or in the previous envelope processing. (The calculating performed here of the envelope levels is such that one of the rates RT is summed up until a sum obtained thereby will amount to one of the break points LBP which corresponds to the one rate RT, and further the same procedure is repeated for all of the other rates RT.)

(ii) The so-called "ADSR" (Attack-Decay-Sustain-Release) analysis is applied to the envelope waveforms produced in the preceding process (i). The value "0" is set at an attack end flag EV"-AT" when the attack part "A" in the waveform is completed (wherein the end of the attack part "A" is detected by deciding whether the envelope level LEV has or has not reached the break point LBP"-AT" corresponding to the end of said attack part "A"). Similarly, the value "0" is set at a decay end flag EV"-DK" when the decay part "D" in the waveform is completed (wherein the end of the decay part "D"is detected by deciding whether the envelope level LEV has reached the break point LBP"-DK" corresponding to the end of said decay part "D"). Further, the value "0" is set for an envelope end flag EV"-END" when the release part "R" in the waveform is completed (wherein the end of the release part "R" is detected by deciding whether the envelope level LEV has reached the break point LBP"-END" corresponding to the end of said decay part "R"). The musical tone-allotting channel for which the envelope end flag EV"-END" has become "0" is thus released to be free for the new musical tone to be allotted thereto.

The suffix "j" of the RT; and $LEP_j$ denotes which changing point in the gradient or slope of the envelope waveform correspond to this data.

It will be understood from the foregoing description that the value "0" can be set to a key state flag KYS in a register KYSR for a corresponding musical tone-allotting channel because the envelope end flag EV"-END" becomes "0" even if the key is not released yet, as far as a musical instrument of "percussive" type is concerned. (Each of the envelope waveform-generating channels is provided with its own groups of the rates $RT_j$ and $LBP_j$, its own break point LBP and envelope level LEV, and its own flags EV"-AT", EV"-DK" and EV"-END". Thus, registers RTjR, LBPjR, RTR, LBPR, LEVR, EV-TR, EV-DKR and EV-ENDR are provided for each envelope waveform-generating channel. Those registers forms one group and are treated with as the one group.

In a case wherein in a key release processing (step I) described below the value "1" is present at a released-key envelope-processing flag RKOF provided in a register RKOFR, the envelope-processing flag RKOF will be reset to "0" to alter the envelope waveform into a released-key envelope after the attack end flag EV"-AT" in the register EV-ATR has become "0" indicating the completion of the attack part "A", provided that the damper state flag FCDS in the register FCDSR is currently at its "0" state indicating that the damper pedal of the pedal group 27 is not trodden. This processing for generating the released-key envelope is similar to that procedure which has been described hereinabove.

The above processing is not conducted if any damper pedal is in its trodden state.

The process returns to Step B after the envelope processing has ended.

Step G

If it is decided at Step E that the processing of the key operation and if the key-operation processing is not finished yet, then the oldest one of the key data BKYD is read from the register BKYR (according to "First-in first-out method"), and a decision is made based on the key state flag BKYS included in this key data BKYD as to whether the key corresponding thereto is or is not at its depressed state. If no, i.e., if the key is deemed released due to "0" appearing at said key state flag BKYS, then the process goes to Step I.

Step H

If yes at the decision at Step G, that is if the key state flag BKYS carries "1" at that time indicating the depressed state of the key, then a routine program for the depressed-key processing commences. This routine program will be detailed later referring to FIG. 4. After the depressed-key processing routine has come to an end, the process returns to Step E.

Step I

If no at the decision made at Step G, that is if the key state flag BKYS carries "0" at that time indicating the released state of the key, then "1" is subtracted from the total number BKEN which is written in the register BKENR indicating the number of the processing-waiting keys. The total number BKEN from which "1" has been subtracted here is then written in said register BKENR as the new number of the processing-waiting keys.

Subsequently, reference is made to the key code BKYC which is included in the key data BKYD written in the register BKYR, in order to treat with the key code KYC and the key state flag KYS which are respectively written in the registers KYCR and KYSR for each musical tone-allotting channel. Any musical tone-allotting channel for which the key code KYC coincides with the key code BKYC and simultaneously the key state flag KYS is carrying "1" indicating the depressed state of key will be subjected to the following processing. That is, "1" indicating that the released-key processing is being done will be set to the released-key envelope-processing flag RKOF while the key state flag KYS is set to carry "0" indicating the released state, thereby commanding the start of the released-key processing before returning to Step E.

If, however, such a musical tone-generating channel as just described is not found, then the process returns to Step E without effecting here such a processing also described just above.

It is to be noted that the musical tone-generating circuit 29 generates musical tones based on the data which have been allotted to the waveform producing channels and the musical tone-allotting channels each corresponding to one of the musical tone-generating channels.

Figure 4:
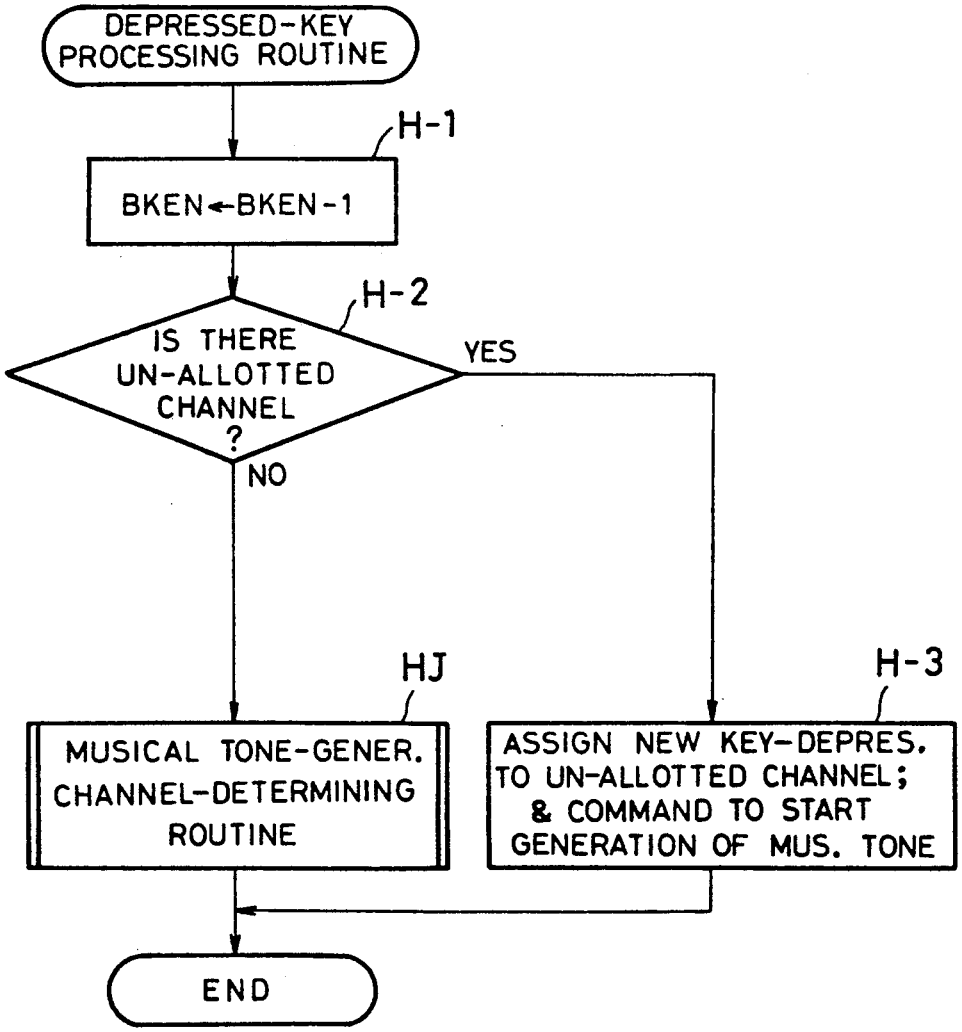

Each step in the depressed-key processing will now be described in detail with reference to FIG. 4.

H-1: "1" is subtracted from the total number BKEN which is written in the register BKENR indicating the number of the processing-waiting keys. The total number BKEN from which "1" has been subtracted here is then written in said register BKENR as the new number of the processing-waiting keys.

H-2: A search is made to find any musical tone-generating channels for which "0" is currently carried by the key state flag KYS and also by the envelope end flag EV"-END", the former flag written in the register KYSR for each musical tone-generating channel and the latter flag written in the flag EV-ENDR for each envelope waveform-generating channel. In other words, a decision is made as to whether there are any musical tone-generating channels to which no musical tones are allotted and therefore which are available for new musical tones. If no at this decision, then the process goes to Step HJ.

H-3: If yes at the decision at Step H-2, then one of the available musical tone-generating channels is selected, and the allotting of the new musical tone to the selected musical tone-generating channel is conducted as follows.

At first, the processing is effected as to the key code KYC, the key state flag KYS, the touch response data KTD and pitch data FQY which are provided for each of such musical tone-allotting channels that respectively correspond to the musical tone-generating channels. The key code BKYC, the key state flag BKYS indicating "1" and the touch response data BKTD which constitute the predetermined key data BKYD read from the register BKYR will be be registered respectively in the register KYCR as the key code KYC, in the register KYSR as the key state flag KYS and in the register KTDR the touch response data KTD which as a whole constitute the key data KYD. Further, the group of the parameters GTEm relating to the generating of musical tones and written in the corresponding registers GTEmR are used together with the key codes KYC written in the register KYCR, in order to calculate them to produce and write the pitch data FQY in a register FQYR.

The released-key envelope-processing flag RKOF for the corresponding envelope waveform-generating channel is reset to "0" and written in the register RKOFR, with the register LEVR for the envelope levels LEV being cleared at the same time. Furthermore, reference is made to a predetermined table in the ROM 21B in order to read therefrom a suitable envelope waveform. This envelope waveform is utilized to calculate a group $RT_j$ of rates RT and a group $LBP_j$ of break points LBP of the envelope level, based on the aforedescribed group of the parameters GTEm relating to the producing of musical tones and written in the corresponding register GTEmR, further based on a key code KYC and a touch response data KTD respectively written in corresponding registers KYCR and KTDR described hereinbefore. Each of the rates RT is the change per unit time in the envelope level (and includes a mathematical sign "+" or "−" according to whether the envelope level is or is not increasing at that instant of time). Each of the break points LBP is such an envelope level that will be found at a point at which a curve forming an envelope waveform will sharply change its gradient, the envelope level being determined by consecutively integrating the data of rates RT in course of time. The value "1" being set to the registers EV-ATR, EV-DKR and EV-ENDR. Reset subsequently is a value TKOF written in a register TKOFR to indicate a period from start of the generating of musical tone to the releasing of the corresponding key.

Finally, a command is given to start the generating of the musical tone which was allotted to the appropriate channel as described above, and this routine program ends after a timer TST is reset which is written in one of the registers TSTR to count the time lapse after the start of the generating of musical tone, the registers TSTR being provided respectively for the musical tone-allotting channels.

The values TKOF and TST are incremented by "1" in response to each of timer interrupts which are given by the timer circuit 21D at regular intervals of time.

HJ: If there is found at the decision made at Step H-2 no musical tone-generating channel to which any musical tone has not been allotted yet, then started is a musical tone-generating channel-determining routine described below referring to FIG. 5. The process returns to Step E upon finish of this routine.

Figure 5:
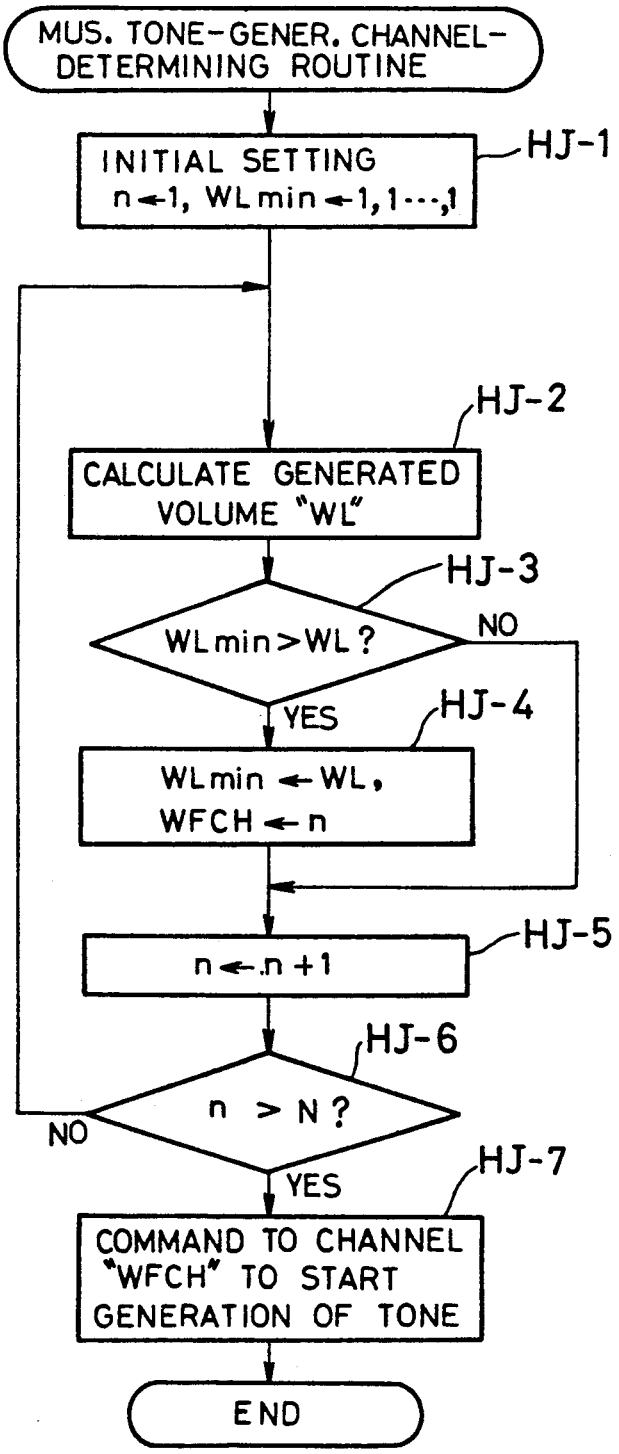

Each step of the musical tone-generating channel-determining routine shown in FIG. 5 is now described in detail.

HJ-1: A loop number "n" written in a register nR is initially set at "1". The highest possible value of minimum generated volume $WL_{min}$ is initially written in a register $WL_{min}R$ by setting "1" to all of the predetermined bits thereof.

HJ-2: A residual generated volume WL which is remaining to be generated through the musical tone-generating channel corresponding to the loop number "n" written in the register nR is determined by means of the equation given below and written in a register WLR. The determination of the residual generated volume is effected by integrating, but in the practical sense by summing up the envelope levels LEV which appear at predetermined intervals during a period from a time $t_o$ to another time $t_{end}$, the former being a start time such that a command is given to release one proper musical tone-generating channel, and the latter time being an end time when the generating of the thus allotted musical tone will end. The end time $t_{end}$ is obtained by simulation of the envelope waveform of said musical tone. (The simulation of waveform is performed in such a manner that the key code BKYC (KYC), the touch response data BKTD (KTD), the manually operable member data MNPh and the damper state flag FCDS are used to calculate based on the table in the ROM 21B the group of the rates $RT_j$ and the group of the break points $LBT_j$. The process of formation of the envelope waveform is thus simulated at a high speed so that the envelope levels LEV are calculated at the actual intervals of time (for instance at intervals of 1 millisecond) consecutively within a short period.)

$$WL = \sum_{t_o}^{t_{end}} V(t)dt$$

wherein V(t) is an envelope level at a time "t", $t_o$ is the time when the command is given to release the musical tone-generating channel, and $t_{end}$ is the time when the generating of the musical tone is completed. (The time $t_o$ is obtained by reading the timer TST written in the corresponding register TSTR to count the time lapse after the start of the generating of the musical tone, when the command to release the musical tone-generating channel is given, while the other time $t_{end}$ is obtained by the simulation described above.)

Though the description was simplified here by omitting some lengths of time necessary for some other data processings, they may be added if required.

The residual generated volume WL may be computed according to any one of the following equations which may be employed instead of the abovementioned equation.

$$WL = \sum_{t_o}^{t_{end}} \log V(t)^2 dt \quad (1)$$

wherein the logarithms of the power of generated tone are integrated for the period from the time $t_o$ of giving the command to release the musical tone-generating channel to the time $t_{end}$ when the generating of the musical tone is completed by said channel. (This equation is based on a fact that the sound pressure is proportional to the square of envelope level, and the logarithm of sound pressure is a more appropriate measure to the human auditory sense, provided that the electric-to-acoustic conversion system is well expressed as a linear relationship.)

$$WL = \sum_{t_o}^{t_{end}} VL(t)dt \quad (2)$$

wherein the loudness levels of generated tone are integrated for said period from the time $t_o$ of the release command to the time $t_{end}$ of the completion of the musical tone generation, after calibration of the loudness levels has been done to improve their fidelity to the human auditory sense. (The loudness level (VL-phon) "VL(t)" at the time "t" may be obtained by using the equal-loudness curve of Fletcher-Munson et al., and the sound pressure may be obtained taking account of: the envelope level LEV; the data on the volume controlling member or other member disposed at the downstream side of the musical-tone generating circuit 29; and the data input from the manually operable members for the outputting devices (for example, the amplifier and the loudspeaker). Alternatively, in a simpler manner, the most standard sound pressure may be estimated and employed in an easy processing. The frequency of the loudness level (VL-phon) "VL(t)" is deemed to be the frequency which is observed on a predominant spectrum component of the musical tone when the attenuation thereof has proceeded to a significant degree.

$$WL = \sum_{t_o}^{t_{end}} VN(t)dt \quad (3)$$

wherein the loudness is integrated for the period from the time $t_o$ of giving the command to release the musical tone-generating channel to the time $t_{end}$ when the generating of the musical tone is completed by said channel. (Although the predominant spectrum component is simply used to represent the tone in the procedure described at the paragraph (2), it is preferable to estimate all of the spectrum components which will be found at that time. Therefore, the loudness (VN-sone) "VN(t)" needed in the procedure at this paragraph (3) is obtained by converting the loudness level (VL-phon) "VL(t)" by means of H. Fletcher's equation: $N=0.046*10$. If $VL(t)<40$, then $VN(t)=1$ is used.)

More details relating to the procedures at the paragraphs (2) and (3) are given in the book "Chokaku to Onsei" (i.e., "Auditory Sense and Audible Sound"), edited and published by the Japanese nonprofit association "Denshi Tsushin Gakkai" ("The Electronic Telecommunication Society"), on pages 104 to 123.

HJ-3: A decision is made as to whether the residual generated volume WL written in the register WLR is or is not less than the minimum generated volume $WL_{min}$ written in the register $WL_{min}R$. If no at this decision, then the process skips to Step HJ-5.

HJ-4: If yes at the decision at Step HJ-3, then the residual generated volume WL is regarded as the minimum generated volume $WL_{min}$ and thus written in the register $WL_{min}R$. The number of loops (i.e., the loop number) "n" written in the register nR is regarded as a channel number WFCH of the channel which is to be allotted, and therefore is written in a register WFCHR.

HJ-5: "1" is added to the current loop number "n" to make a sum as a renewed loop number "n" to be written in the register nR.

HJ-6: A number "N" which is "16" representing the number of the musical tone-generating channels in the first embodiment and is stored in the ROM 21B will be compared with the loop number "n". Namely, a further decision is made here as to whether the loop number "n" is or is not more than the number "N" of the musical tone-generating channels. If no at this decision, in other words, if there is any musical tone-generating channel which has not undergone yet the abovementioned processings, then the process returns to Step HJ-2 so as to continue to select the musical tone-generating channels.

HJ-7: If yes at the decision made at Step HJ-6, in other words, if all of the musical tone-generating channels have undergone the abovementioned processings and have been selected by referencing to the numbers WFCH indicating the assignable channels and written in the register WFCHR, then a processing similar to that at the Step H-3 is conducted to give a command to the selected musical tone-generating channels to start to generate the allotted musical tones.

As a summary of the musical tone-generating channel determining routine, each demand to release the channel causes the program to find integrals of the residual generated volumes WL with respect to the already allotted channels for the period from the point $t_o$ of said each demand to the points $t_{end}$ when the generating of tones will be finished by said already allotted channels. As a result of such a calculation, the musical tone-generating channel which has the least residual generated volume WL and thus will bring about the least undesirable musical effect is preferentially selected and released in a sequential manner for each demand to release the channels.

Although the shape of envelope waveform is disregarded in selecting the musical tone-generating channels in the above-mentioned channel-determining routine, the selection of said channels may be effected on condition that the attack part "A" in the envelope waveform has ended. Adequate processing for accelerated attenuation may be carried out to avoid any undesirable audible effect which might be produced by abrupt termination of such a musical tone that is being generated when the selection of channels is performed. The envelope level LEV may also be considered so that any musical tone of a significant envelope level LEV will not be muted, giving a feeling of incongruity. For example, three musical tone-generating channels ranked high in respect of their current envelope levels $LEV_o$ which will be found at the time $t_o$ when the demand to release them is given may not be released, provided that the number of releasable channels for each of which the attack part "A" is finished is greater than that of demanded channels, and comparison of current envelope levels $LEV_o$ is done among all the musical tone-generating channels including those for which the keys are being depressed. If such a procedure results in deficiency in the releasable channels, then only two or one musical tone-generating channels ranked high as to their current envelope levels may be excluded from the selected channels. Further, an appropriate weighting processing may be adopted in deciding which component of musical tone is to be continued in a case wherein each musical tone comprises a plurality of tone components. A greater weight "1.5" may be assigned, for instance, to predominant tone components with a lighter weight "1.0" being assigned for instance to subordinate tone components, whereby there will be felt as if there were being generated a greater number of effective musical tones than in a case wherein no such a weighting processing is conducted, because the predominant tone component of one musical tone which is of the same envelope level as that of the subordinate tone components of the other musical tones will be kept alive.

SECOND EMBODIMENT

This is a second embodiment according to the first aspect of the invention wherein it is applied to the musical tones of "sostenuto" nature, whereas the foregoing first embodiment relates to those of "percussive" nature.

Here will be given a description, referring to FIGS. 6 and 7, only of the matters which are different from those in the first embodiment illustrated in FIGS. 2 to 5.

The sostenuto musical tones generated by, for instance, organs during key-depression have envelope waveforms which depend upon the duration of depressed state of keys on the organs. Thus, the envelope waveforms cannot be predetermined so far as the keys are being depressed. It is, however, possible to predict the envelope waveforms which are inherently definite for a period from the releasing of keys to the ends of the tones which have been generated by the keys. Therefore, the envelope waveform for any key which has been released can be estimated by simulation based on the time lapse after the key-release until the point $t_o$ when a command to release the musical tone-generating circuit, the simulated envelope waveform being that which starts from said point $t_o$ and continues until the point $t_{end}$ of completion of musical tone-generation as to the key. The simulation of the envelope waveform can be executed in a manner similar to the aforementioned simulation in the first embodiment. In detail, the simulation is performed here also by using the values TKOF in addition to the group of the rates $RT_j$ and the group of the break point levels $LBP_j$ which are necessary for the producing of the envelope waveforms, said values TKOF indicating the period from the start of musical tone-generation to the releasing of key.

Figure 6:
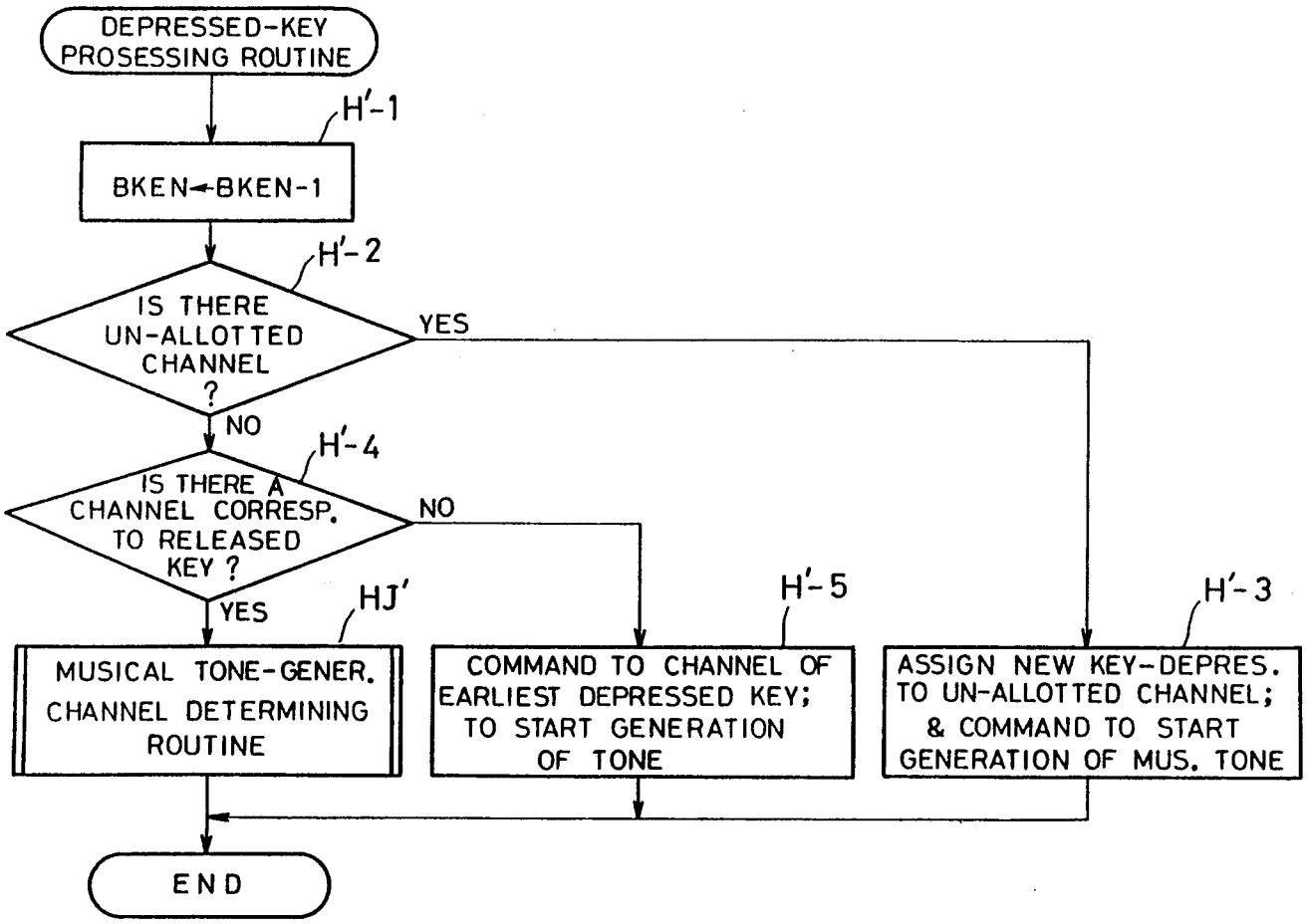
Figure 7:
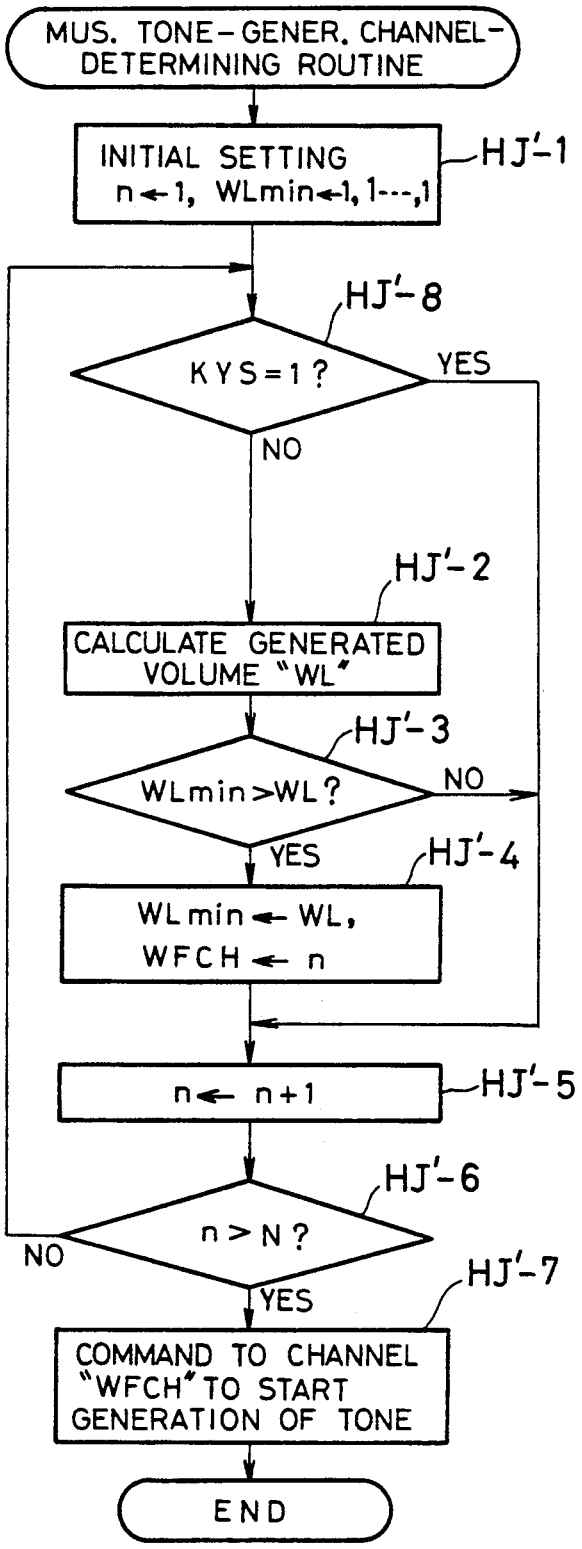

The depressed-key processing routine given in FIG. 6 comprises Step H'-1 to H'-3 which correspond to and are the same as those in the first embodiment. Said routine in FIG. 6 further comprises Steps H'-4, H'-5 and HJ' which will be described below.

H'-4: Each of the key state flags KYS written in the registers KYSR corresponding to the musical tone-allotting channels is checked to confirm if it is carrying "0". Then, a decision is made as to whether there is or is not any musical tone-generating channel for which the corresponding key is at its released state. If yes at this decision, then the process advances to Step HJ'.

H'-5: If no at the decision made at Step H'-4, then the musical tone-generating channel corresponding to the earliest depressed key is allotted to the new musical tone, in the same manner as at Step H-3 (identical with Step H'-3). A command is given to said channel to start the generating of said new musical tone.

HJ': In a case where any musical tone-generating channel is found relevant to the released key, the musical tone-generating channel-determining routine is started. This routine, as seen in FIG. 7, comprises Steps HJ'-1 to HJ'-7 which are respectively identical with the afore-described Steps HJ-1 to HJ-7 as well as HJ'-8 which is peculiar to this embodiment and will be described below.

HJ'-8: A decision is made as to whether the key state flag KYS in the register KYSR is or is not at its state "1". If yes, that is, if the key is being depressed, then the process skips to Step HJ'-5. This means that as described above the envelope waveform cannot be definitely determined even if the residual generated volume WL were calculated, because the length or duration of waveform of the sostenute sounds depends upon the duration of the depressed state of key.

This channel-determining routine to determine the musical tone-generating channels in the second embodiment is so composed that new musical tones are allotted to said channels irrespective of the current part in the envelope waveform. However, the allotting of each of the new musical tones to one of the channels may be conducted on a condition that the attack part is over as to the current musical tone which has been being generated through the channel to be allotted. Also, accelerated attenuation may be preferable as in the first embodiment since sudden termination of the current musical tone is undesirable in determining said channels to be allotted to the new musical tones.

In a case wherein the so-called "multi-timbre" output is desired to mix the percussive sounds with the sostenuto sounds, the decision made at Step H'-4 may be revised such that a different decision is made as to whether there are or are not any musical tone-generating channels which are generating any percussive sound and/or any sostenuto sound, the sostenuto sound corresponding to the already released key. In this case, Step HJ' may also be revised to make comparison between the residual generated volumes of all of said percussive sounds and all of the sostenuto sounds corresponding to said already released keys.

MODIFICATION OF SECOND EMBODIMENT

The residual generated volumes WL are obtained by the simulation of the envelope waveforms, according to the second embodiment described above. However, the second embodiment may be modified in the light of a fact that the envelope level attenuates in a comparatively monotonous manner after the attack part is over in the envelope waveform. Thus, the residual generated volume WL can be obtained based on the envelope level $LEV_o$ and a rate $RT_o$ which are present at the time $t_o$ when the channel releasing command is given to the musical tone-generating channel. Description of such features in this modification as are included in common with those in the second embodiment are not repeated here, but only the differences therebetween will be summarized below.

It is to be noted at first that any "real" values of the residual generated volume are not required but "relative" values are sufficient for the present purposes. Therefore, the following equation:

$$WL = LEV_o * LEV_o / (-RT_o)$$

can be employed for simpler data processing because the duration of the generating of musical tones is calculated by dividing the envelope level LEV by the rate RT, thus the product of the duration multiplied by the envelope level LEV giving an approximate value of said residual volume WL.

Figure 8:
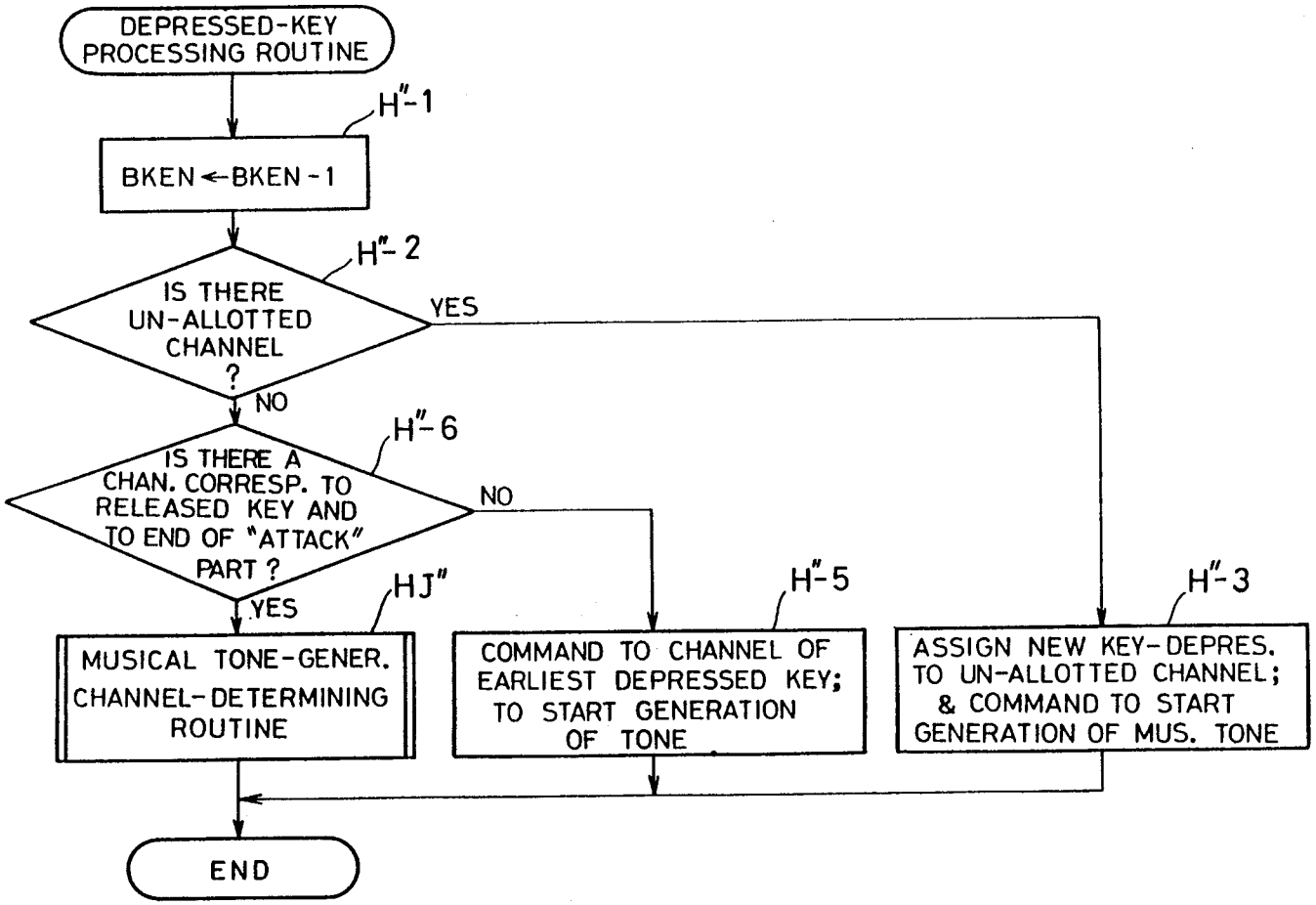

In the depressed-key processing routine shown in FIG. 8, Steps H''-1 to H''-3 and Step H''-5 are respectively identical with Steps H'-1 to H'-3 and Step H'-5 described above. Steps H''-6 and HJ'' which are characteristic in this modification are as follows.

Figure 9:
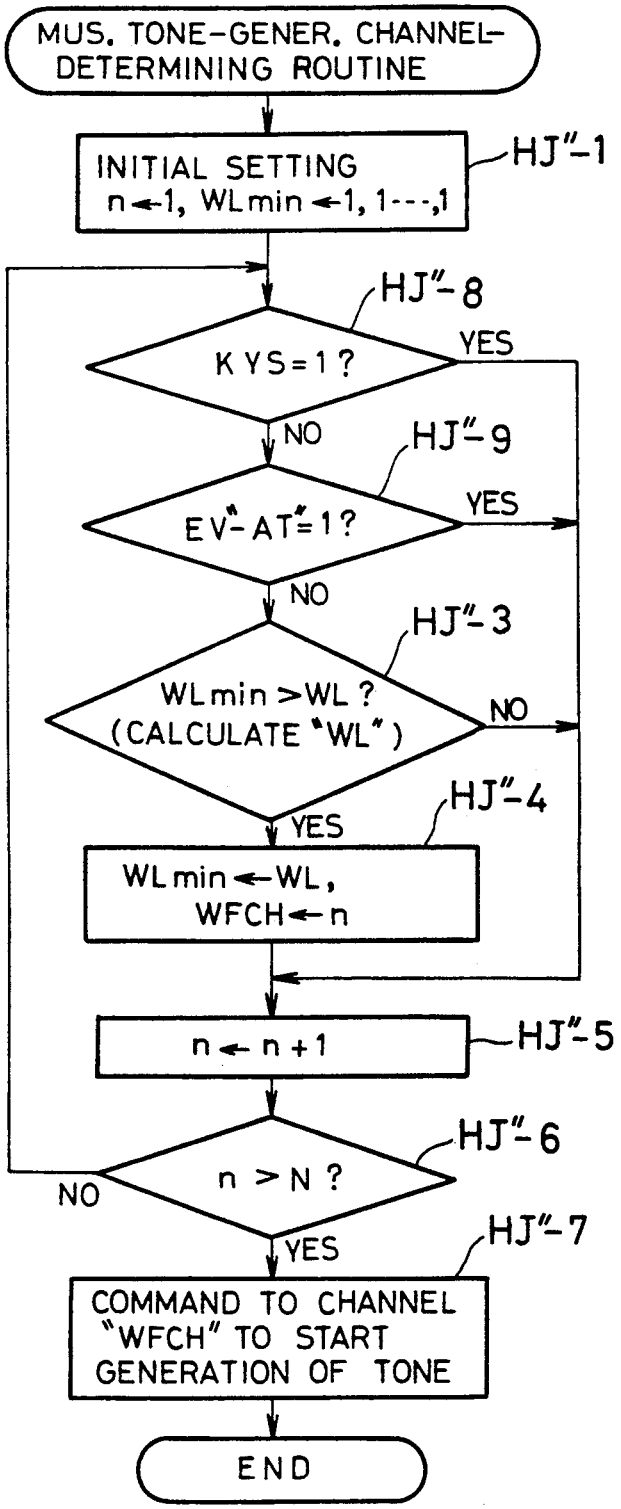

H''-6: Each of the key state flags KYS written in the registers KYSR corresponding to the musical tone-allotting channels is checked to find if it is carrying "0", and at the same time each of the attack end flag EV"-AT" written in the registers EV-ATR corresponding to the envelope waveform-producing channels is checked to find if it is carrying "0". Consequently, a decision is made as to whether there is any musical tone-generating channel for which the key has been released and the attack part is already over after the end of the attack part. In other words, here made is a search for any musical tone-generating channel to which the above equation can be applied to calculate the approximate value. If any channel is found to which such a procedure is applicable, then the process goes to Step HJ'' (shown in FIG. 9) where the determining of said channel is carried out using the approximate value of the residual generated volume WL.

The Step HJ'' for determining the musical tone-generating channel is similar to the aforedescribed Step HJ' except for the adoption of the abovementioned equation:

$$WL = LEV_0 * LEV_0 / (-RT_0)$$

step HJ''-1 and Steps HJ''-4 to HJ''-8 are identical with the already described Steps HJ'-1 and Steps HJ'-4 to HJ'-8, respectively. Step HJ''-3 corresponds to a combination of Step HJ'-2 with Step HJ'-3. This modification's particular Step HJ''-9 is as follows.

HJ''-9: a decision is made as to whether the attack end flag EV"-AT" is or is not "0", which flag is written in the register EV-ATR corresponding to the musical tone-generating channel which in turn corresponds to the loop number "n". If yes indicating that the attack part "A" of the envelope waveform is not yet over, then the process skips to Step HJ''-5. This is a processing conducted merely to simplify the treatment of the mathematical signs of the rate RT which change from "+" into "−" when the attack part ends in the waveform.

The above-described modification of the second embodiment may be further modified by deleting Steps H''-5 and H''-6 such that the percussive sounds can be treated with. Step HJ''-8 may be further removed from the channel determining routine wherein the current rate RT of decay part "D" is set to the rate $RT_0$ and at at the same time the break point LBP"-AT" corresponding to the end of attack part is set to the $LEV_0$ in the equation mentioned above if the attack part end flag EV"-AT" is "1", ,before the process advances to Step HJ''-3.

A third embodiment and a fourth embodiment of the present invention will now be described according to a second aspect thereof. In order to avoid duplication, only the features characteristic of these embodiments are summarized below.

THIRD EMBODIMENT

Figure 3:
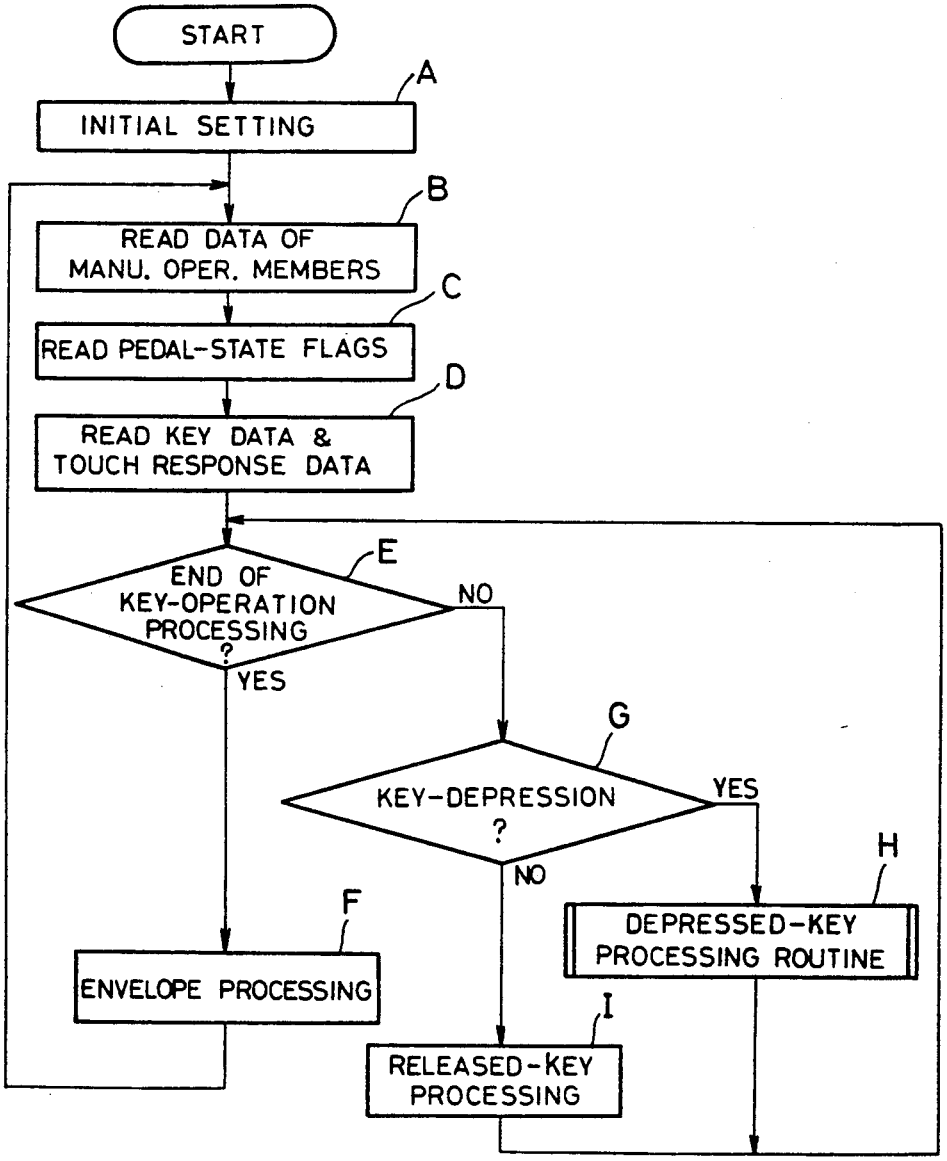

The sostenuto system like the organ or the likes relates to this embodiment in which its outline and its basic flowchart of microcomputer program may be given in FIGS. 2 and 3 because they are the same as those in the first and second embodiment described hereinbefore according to the first aspect of the invention. Its depressed-key processing routine in the basic flowchart is also identical with that which is shown in FIG. 6 and is included in the second embodiment. Each step in its channel determining routine different from those included in the foregoing embodiments will be described below referring to FIG. 10 .

HJ'-11: "1" as the loop number "n" is set to the register nR, and "1" is also set to all of the predetermined bits of the register WLEVR in which the minimum envelope level WLEV is written, thereby a possible maximum value of said minimum envelope level WLEV being initially set.

HJ'-12: A decision is made as to whether the key state flag KYS is or is not carrying "1". If yes, that is, if the key is at its depressed state, then the process skips to Step HJ'-16 because the musical tone-generating channel corresponding to the depressed key cannot be subject to selection.

HJ'-13: If no at the decision made at Step HJ'-12, that is, if the key is at its released state, then a further decision is made as to whether the attack part end flag EV"-AT" written in the register EV-ATR is or is not carrying "1" for the musical tone-generating channel corresponding to the loop number "n". If yes, that is, if the attack part is not over yet, then the process skips to Step HJ'-16.

HJ'-14: If no at the decision at Step HJ'-13, that is, if the flag EV"-AT" is carrying "0", then a still further decision is made as to whether the envelope level $LEV_0$ at the instant when the command to release any proper channel is given is or is not lower than the minimum envelope level WLEV written in the register WLEVR, for the musical tone-generating channel corresponding to the loop number "n". If no at this still further decision, then the process skips to Step HJ'-16.

HJ'-15: If yes at the decision made at Step HJ'-14, then the envelope level $LEV_o$ is written, as the minimum envelope level WLEV, in the register WLEVR.

HJ'-16: "1" is added to the loop number "n" so as to produce a renewed loop number written in the register nR.

HJ'-17: A decision is made here as to whether the loop number "n" written in the register nR is greater than a number "N" which is "16" (sixteen) written in the ROM 21B as the total number of the musical tone-generating channels in the third embodiment. If no, indicating that the checking of all of the musical tone-generating channels is not finished yet, then the process returns to Step HJ'-12 to continue the detection of the maximum envelope levels WLEV.

Steps HJ'-11 to HJ'-17 are adapted to search the minimum one of the envelope levels $LEV_o$ of the musical tones which are allotted to the musical tone-generating channels at the time when the command is given to release any proper one of said channels.

HJ'-18: The loop number "n" written in the register nR is reset to "1". "1" is also set to all of the predetermined bits of the register $WL_{min}R$ in which the minimum residual generated volume $WL_{min}$ is written, thereby a possible maximum value of said minimum residual volume $WL_{min}$ being initially set in said register.

HJ'-19: Written in a register PLEVR is an allowable minimum value PLEV of the envelope levels $LEV_o$ found at the instant when the command is given to release the current musical tone from any selectable channel to which said tone has been allotted, the allowable maximum envelope level PLEV being defined as twice the minimum envelope level WLEV written in the register WLEVR.

HJ'-20, HJ'-21 These steps are identical with Steps HJ'-12 and HJ'-13, respectively. In a case wherein the key state flag KYS is "1" showing the depressed state of the key, or the attack part end flag EV"-AT" is "1" showing the non-completion of the attack part, then the process skips to Step HJ'-25.

HJ'-22: If the attack part end flag EV"-AT" is decided at Step HJ'-21 to be "0" indicating the completion of said attack part, then a further decision is made here as to whether the envelope level $LEV_o$ at the instant when the command to release any proper channel is given is or is not lower than the allowable maximum envelope level PLEV written in the register PLEVR, for the musical tone-generating channel corresponding to the loop number "n". If no at this decision, then the process skips to Step HJ'-25.

HJ'-23: If yes at the decision made at step HJ'-22, then the residual generated volume WL is calculated similarly to the procedure at Step HJ"-2 or HJ-2, at first. Subsequently, a still further decision is made as to whether the residual volume WL is or is not less than the minimum residual volume $WL_{min}$ written in the register $WL_{min}R$. If no, then the process skips to Step HJ'-25.

HJ'-24: If yes at the decision made at Step HJ'-23, then the residual generated volume WL is written in the register $WL_{min}R$, as the minimum residual volume $WL_{min}$. Further, the loop number "n" written in the register nR is used as the ordinal number WFCH of the allottable channel and is written in the register WFCHR.

HJ'-25, HJ'-26: These steps are identical with Steps HJ'-16 and HJ'-17, respectively, so that in a case wherein the the loop number "n" is not greater than the total number "N" thereby indicating a fact that the checking of all of the musical tone-generating channels is not finished yet, then the process returns to Step HJ'-20 so as to continue the search for the minimum residual generated volume $WL_{min}$.

HJ'-27: If the loop number "n" is decided at step HJ'-26 to be greater than the number "N", then it is concluded that the checking of all of the musical tone-generating channels is completely finished. As a result, it is confirmed that the most adequate musical tone-generating channel has thus been selected which carries the selectable channel number WFCH written in the register WFCHR. Therefore, a command is given to the thus selected channel to generate a given musical tone.

The abovedescribed Steps HJ'-18 to HJ'-27 are so composed that the selection of the musical tone-generating channel which corresponds to the minimum residual generated volume $WL_{min}$ is carried out by comparing the residual volumes WL with each other, on a condition that the envelope levels $WLEV_o$ at the instant when the channel releasing command is given to fall within a predetermined range which is defined to extend from the detected minimum envelope level WLEV to such an allowable maximum envelope level PLEV as is twice the said minimum level WLEV.

In summary, the third embodiment is characterized in that the musical tone-generating channels which are generating musical tones of current envelope levels $LEV_o$ higher than a criterion, for instance in this embodiment, a value which is twice the minimum envelope level WLEV are prevented from being released so as not to produce any feeling of incongruity.

Accelerated attenuation is desirable so that the current tone should not be suddenly muted in selection of the musical tone-generating channels.

In a case wherein the so-called "multi-timbre" output is desired to mix the percussive sounds with the sostenuto sounds, the decision made at Step H'-4 may be revised such that a different decision is made as to whether there are or are not any musical tone-generating channels which are generating any percussive sound and/or any sostenuto sound, the sostenuto sound corresponding to the already released key. In this case, Step HJ' may also be revised to make comparison between the residual generated volumes of all of said percussive sounds and all of the sostenuto sounds corresponding to said already released keys.

The above-described third embodiment may be further modified by deleting Steps H'-4 and H'-5 such that the percussive sounds can be treated with. Steps HJ'-12 and HJ'-20 may be further removed from the channel determining routine wherein the current rate RT of decay part "D" is set to the rate $RT_o$ and at the same time the break point LBP"-AT" corresponding to the end of attack part is set to the $LEV_o$ in the equation mentioned above, if the attack part end flag EV"-AT" is "1", before the process advances to Steps HJ'-14 and HJ'-22, respectively.

FOURTH EMBODIMENT

This embodiment is based on a fact that the residual generated volumes WL are proportional to residual periods of time WT within which the current musical tones are finished, provided that the corresponding envelope levels $LEV_o$ are scarcely different from each other. According to the fourth embodiment, one musical tone-generating channel generating the musical tone of the shortest residual period WT is selected from those through which are being generated the musical tones of almost the same envelope level $LEV_o$ when the channel releasing command is given, whereby the data processing is further simplified. Only the features different from those in the third embodiment will be described below, avoiding duplicate description of the common features.

Figure 10:
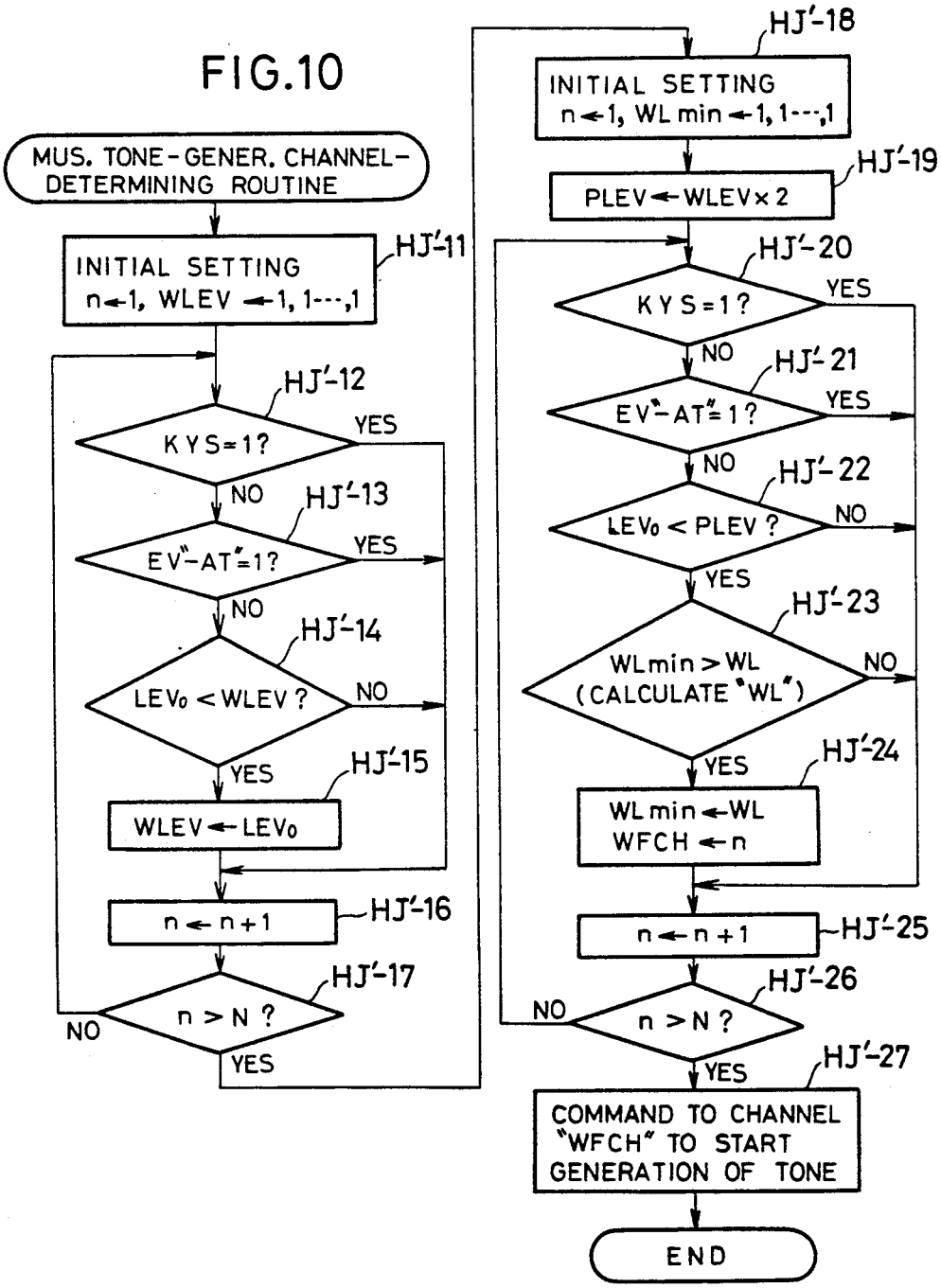
FIG. 10 shows a further routine for the determining of musical tone-generating channel, the further routine relating to a further basic flowchart in a third embodiment which constitutes the second aspect of the invention.

The flowchart in FIG. 10 which has been referred to in the third embodiment is referred to again. Description will be made below only as to Steps HJ"-18, HJ"-19, HJ"-23 and HJ"-24 which are included in the fourth embodiment and are respectively substituted for the Steps HJ'-18, HJ'-19, HJ'-23 and HJ'-24 in the third embodiment, the other steps therein being not described because they are common in both the embodiments.

HJ"-18: The loop number "n" in the register nR is reset to "1", and "1" is also set to all of the predetermined bits of the register $WT_{min}R$ in which the minimum residual period of time $WT_{min}$ is written, thereby a possible maximum value of said minimum residual period $WT_{min}$ being initially set in said register.

HJ"-19: Written in the register PLEVR is the allowable maximum value PLEV of envelope levels $LEV_o$ found at the instant when the command is given to release the current musical tone from any selectable channel to which said tone has been allotted, the allowable maximum envelope level PLEV being defined in this case to be "1.4" times the minimum envelope level WLEV written in the register WLEVR.

HJ''-23: A decision is made as to whether the residual period of time WT defined by the following equation:

$$WT = LEV_o / (-RT_o)$$

is or is not lower than the minimum residual period $WT_{min}$ written in the register $WT_{min}R$, (in a case wherein the envelope level $LEV_o$ at the instant when the channel releasing command is given is decided at Step HJ'-22 to be lower than the allowable maximum envelope level PLEV written in the register PLEVR.) This equation is derived, as mentioned above, from a fact that the residual period WT equals to a quotient of the envelope level $LEV_o$ divided by the rate $RT_o$ which are found at the time when the channel releasing command is given. The sign "−" which is involved in said equation for the purpose of adequate computation does mean that the rate $RT_o$ is a minus value because the envelope waveform is attenuating after the releasing of key. (If the residual period WT is not lower than the minimum value thereof $WT_{min}$, then the process skips to HJ'-25.)

HJ''-24: If the residual period of time WT for generating the musical tone is decided at Step HJ''-23 to be lower than the minimum value thereof $WT_{min}$, then the period WT is written as said minimum value $WT_{min}$ in the register $WT_{min}R$. The loop number "n" in the register nR is written as the allottable channel number WFCH in the register WFCHR.

Summarizing the fourth embodiment, the range covering the envelope levels of from the detected minimum level WLEV to the allowable maximum level PLEV which is 1.4 times the WLEV is utilized as a condition on which the musical tone-generating channel is selected if its residual period WT for generating musical tone is the shortest corresponding to the minimum residual generated volume $WL_{min}$. In another case wherein the allowable maximum level PLEV is set higher than 1.4 times the WLEV, the range or variation of the residual volume WL becomes greater for the musical tones whose envelope levels $LEV_o$ fall within a given scope (lower than the allowable maximum envelope level PLEV).

This means that such a musical tone-generating channel as having the residual volume WL less than the abovementioned minimum residual generated volume $WL_{min}$ (which is applicable if the allowable maximum level PLEV is set to be 1.4 times the minimum level WLEV) may be subject to the selection, even if its envelope level $LEV_o$ were higher than the also abovementioned allowable maximum level PLEV (which is 1.4 times the minimum level WLEV) at the time of the channel releasing command. It is to be noted that timbre or other factors give an influence on the harmonization between the range of said residual volume WT and the range of said envelope level $LEV_o$ so that the most preferable relationship is to be adopted on a case by case basis, taking into account said factors.

FIFTH EMBODIMENT

This embodiment is based on a further fact that the residual generated volumes WL are proportional to the rate $RT_o$ at the time of the channel releasing command, provided that the corresponding envelope levels $LEV_o$ are scarcely different from each other. According to the fifth embodiment, one musical tone-generating channel generating the musical tone of the lowest rate $RT_o$ (corresponding to the furthest progression of attenuation) is selected from those through which are being generated the musical tones of almost the same envelope level $LEV_o$ when the channel releasing command is given, whereby the data processing is further simplified. Only the features different from those in the third embodiment will be described below, avoiding duplicate description of the common features.

The flowchart in FIG. 10 which has been referred to in the third embodiment is referred to again. Description will be made below, similarly to the fourth embodiment, only as to Steps HJ'''-18, HJ'''-19, HJ'''-23 and HJ'''-24 which are included in the fifth embodiment and are respectively substituted for the Steps HJ'-18, HJ'-19, HJ'-23 and HJ'-24 in the third embodiment, the other steps therein being not described because they are common in both the embodiments.

HJ'''-18: The loop number "n" in the register nR is reset to "1", and "1" is also set to all of the predetermined bits of a register $WRT_{min}R$ in which a minimum rate $WRT_{min}$ is written, thereby a possible maximum value of said minimum rate $WRT_{min}$ being initially set in said register.

HJ'''-19: Written in the register PLEVR is the allowable maximum value PLEV of envelope levels $LEV_o$ found at the instant when the command is given to release the current musical tone from any selectable channel to which said tone has been allotted, the allowable maximum envelope level PLEV being defined in this case to be "1.2" times the minimum envelope level WLEV written in the register WLEVR.

HJ'''-23: A decision is made as to whether the rate $RT_o$ at the time of the channel releasing command is or is not lower than the minimum rate $WRT_{min}$ written in the register $WRT_{min}R$, (in a case wherein the envelope level $LEV_o$ at said time is decided at Step HJ'-22 to be lower than the allowable maximum envelope level PLEV written in the register PLEVR.) (If no at the decision made at this Step HJ'''-23, then the process skips to HJ'-25.)

HJ'''-24. If yes at the decision made at Step HJ'''-23, then the rate $RT_o$ is written as said minimum value $WRT_{min}$ in the register $WRT_{min}R$. The loop number "n" in the register nR is written as the allottable channel number WFCH in the register WFCHR.

Summarizing the fifth embodiment, the range covering the envelope levels of from the detected minimum level WLEV up to the allowable maximum level PLEV which is 1.2 times the WLEV is utilized as a condition on which one musical tone-generating channel is selected if its musical tone has the lowest rate $RT_o$ corresponding to the minimum residual generated volume $WL_{min}$. In another case wherein the allowable maximum level PLEV is set higher than 1.2 times the WLEV, the range or variation of the residual volume WL becomes greater for the musical tones whose envelope levels $LEV_o$ fall within a given scope (lower than the allowable maximum envelope level PLEV). This means that such a musical tone-generating channel as having the residual volume WL less than the abovementioned minimum residual generated volume $WL_{min}$ (which is applicable if the allowable maximum level PLEV is set to be 1.2 times the minimum level WLEV) may be subject to the selection, even if its envelope level $LEV_o$ were higher than the also abovementioned allowable maximum level PLEV (which is 1.2 times the minimum level WLEV) at the time of the channel releasing command. It is to be noted that timbre or other factors give an influence on the harmonization between the range of said residual volume WT and the range of said envelope level $LEV_o$ so that the most preferable relationship is to be adopted case by case taking into account said factors.

A further modification of the first to fifth embodiments will now be described.

Although in said five embodiments such a musical tone-generating channel as generating the musical tone of which the residual generated volume WL or the value equivalent thereto is the lowest is allotted to the new tone in the channel determining routine, it is however possible to previously set a sequential order for the releasing of musical tone-generating channels in accordance with the order of the residual volumes WL so that the musical tone of a lower residual volume is preferentially muted and such a channel is allotted earlier than the others having higher or larger residual volumes, to the new musical tone.

For example, the timer circuit 21D may generate at regular intervals of time such timer interrupt signals which causes the setting of the sequential order of the releasing. The residual volumes WL of the musical tones which are to be generated by the channels are calculated in response to each timer interrupt signal. By comparing the residual volumes WL with each other, the releasing order is determined to coincide with an increasing order of the residual volumes. New key-depressions are thus allotted to the musical tone-generating channels in the releasing order in the depressed-key processing routine.

An example of a processing for setting the releasing order (i.e., releasing order-setting timer-interrupt routine) is as follows.

A kind of index (referred to as "volume index (indices)" below) is obtained for each musical tone-generating channel, supposing that the channel releasing command is given to the channels at the start of each interrupt. The residual volumes WL which are calculated in such a manner as in the embodiments are modified to give the volume indices wherein said volumes are multiplied by some modifying factors, or an appropriate table is used. Modification of the volumes must be such that the volume index for the practical maximum of said volumes is, for instance, "127" if the keys are already released and the corresponding envelope waveform-producing channels have passed their attack parts. On the other hand, the residual volumes for which the corresponding keys are already released but the attack parts are not passed yet should be modified to give volume indices between "128" as a minimum and "239" as a maximum. As for the keys which are at their depressed states, the number "239" is added to their depressed orders so as to give "240" for the earliest depressed key and "255" for the latest depressed key, as their volume indices. Thus, the volume indices which are assigned to the musical tone-generating channels are: "0" to "127" for the released keys after the attack part; "128" to "239" for the released keys before the end of said attack part; and "240" to "255" for the unreleased keys.

The releasing order is composed of the ordinal numbers from "1" to "16" in the embodiments wherein "1" is assigned to the musical tone-generating channel having a minimum volume index, and "16" is assigned to the other musical tone-generating channel having a maximum volume index, wherein "1" is set to the register carrying the number of the releasable channels.

Further, it may be also possible neither to allot any new musical tones to a group of the channels for which the corresponding keys are at their depressed states, nor to another group of keys for which the attack part is not over yet in spite of the corresponding already released keys. Alternatively, the releasing order numbers may be given to the latter group of the channels in the order of depression, that is, in the same manner as said numbers are assigned to the former group of the channels. In this latter case, any new musical tones are not allotted to any channels if there were not found any allottable ones.

The depressed-key processing routine is to be modified such that after the number BKEN of processing-waiting keys is renewed, the new musical tone is allotted to the channel corresponding to said register carrying said number of the releasable channels, before "1" is added to said register.

In a case wherein the releasing order-setting timer-interrupt occurs while the envelope processing at Step F or the depressed-key processing at Step H in the basic flowchart is being executed, the execution of the releasing order-setting timer-interrupt routine is deferred until the processing at Step F or H is finished.

Furthermore, an appropriate modification may be made based on the corresponding envelope levels while the calculation of the volume indices or the comparison of the releasing order numbers in the releasing order-setting timer-interrupt routine, in accordance with the concepts described in the third and fourth embodiments. For example, the residual generated volumes may be multiplied by appropriate modification factors which correspond to the envelope levels, when said volume indices are calculated.

All of the registers employed in the first to fifth embodiments are imaginary areas defined in the RAM 21C which is included in the microcomputer 21.

While only certain embodiments of the present invention have been described, it will be apparent to those skilled in the art that the various changes and modifications may be made therein without departing from the spirit and scope of the present invention which will be defined solely by the claims set forth below.

What is claimed is:

1. An electronic musical instrument comprising:

(a) a plurality of musical tone generators to which new musical tones may be allotted for generation to produce audible tones;

(b) calculating means for either calculating residual integrated volumes or substitute values corresponding thereto of each current musical tones which has been allotted respectively to a musical tone generator and are to be further generated after a given instant of time until end points in the generation of the current musical tones; and (c) determining means for selecting which of the musical tone generators corresponds to a tone having a minimum of such residual integrated volume or substitute value corresponding thereto as calculated by the calculating means (d) assigning means for assigning the musical tone generator selected by said determining means a new musical tone to be generated, thereby enabling the generation of said new musical tone.

2. An electronic musical instrument in accordance with claim 1 wherein the substitute values are obtained by multiplying the residual integrated volumes or interim substitute values corresponding to thereto by modification factors.

3. An electronic musical instrument comprising:

(a) a plurality of musical tone generators to which new musical tones may be allotted for generation to produce audible tones;

(b) detecting means for detecting a minimum envelope level among the envelope levels associated with musical tones allotted to each of the musical tone generators that will be found at a given instant of time;

(c) selecting means for selecting the musical tone generators which are allotted musical tones having envelope levels falling within a predetermined range at the given instant of time, the predetermined range being defined based on and including the minimum envelope level detected by the detecting means; and (d) determining means for selecting which of the musical tone generators selected by the selecting means correspond to a tone having a minimum residual integrated volume or substitute values corresponding thereto;

(d) assigning means for assigning the musical tone generators selected by said determining means to new musical tones to be generated, thereby enabling the generation of said new musical tone.

4. An electronic musical instrument in accordance with claim 1 or 3 wherein the residual integrated volumes are calculated by means of an equation:

$$WL = \int_{t_o}^{t_{end}} V(t)dt$$

wherein V(t) is an envelope level at an instant "t" during a period beginning at the given instant "$t_o$" and lasting to the end point "$t_{end}$" of the generation of musical tone.

5. An electronic musical instrument in accordance with claim 1 or 3 wherein the substitute values corresponding to the residual integrated volumes are given by a equation;

$$WL = LEV_o * LEV_o / (-RT_o)$$

wherein $LEV_o$ is the envelope level at the given instant during the attenuation process of envelope waveform, and $RT_o$ is a rate of change per unit time of the envelope level which is attenuating in course of time, the rate of change being made use of to calculate said envelope level.

6. An electronic musical instrument in accordance with claim 3 wherein the substitute values are remaining periods of time at a given instant in the attenuation process of envelope waveforms.

7. An electronic musical instrument in accordance with claim 3 wherein the substitute values are rates of change per unit time of envelopes at a given instant in the attenuation process of envelope waveforms.

8. An electronic musical instrument in accordance with claim 1, 3, 2, 6 or 7 wherein the given instant of time is the time when a generator releasing command is given to the musical tone-generators which are to be allotted to the new musical tones.

9. An electronic musical instrument in accordance with claim 1 or 3 wherein the given instant of time is the time when a releasing command is previously set as to the musical tone-generators before the new musical tones are allotted thereto.

10. The electronic musical instrument of claim 1 or 3 wherein said determining means allocates the new musical tone to the musical tone generators corresponding to the tone having the minimum residual integrated volume.

11. In an electronic musical instrument having a predetermined number of musical tone generators, a method of allotting a new musical tone to an otherwise allotted tone generator comprising:

a) calculating a value related to the residual integrated volume of the envelope of the tone generated by each said musical tone generator; and b) determining the smallest of said values calculated by said step a) of calculating and allocating the new musical tone to the musical tone generator associated with the tone having the smallest said value and allocating the new musical tone thereto to enable that tone generator to play the new note.

12. In an electronic musical instrument having a predetermined number of musical tone generators, a method of allotting a new musical tone to an otherwise allotted tone generator comprising:

a) detecting the minimum envelope level among the envelope levels of musical tones allotted to each said tone generator;

b) selecting all musical tones having envelope levels which fall within a predetermined range, said predetermined range being defined based on and including said minimum envelope level;

c) calculating a value related to the residual integrated volume of the envelope of the tones generated by each said musical tone generator generating a musical tone selected by said step b) of selecting; and d) determining the smallest of said vales calculated by said step c) of calculating and allocating the new musical tone to the musical tone generator associated with the tone having the smallest said value to enable that tone generator to play the new note.

13. The method of claims 11 or 12 further comprising using the musical tone generators to generate music.

* * * * *